US005802905A

United States Patent [19]

Biswas et al.

[11] Patent Number: 5,802,905

[45] Date of Patent: Sep. 8, 1998

[54] PROCESS AND DEVICE FOR APPLYING A TEMPERATURE PROFILE TO METAL BLOCKS FOR EXTRUSION

[75] Inventors: Amit Kumar Biswas, Kaarst; Alfred Steinmetz, Willich, both of Germany; Ivar Venaas, Chartres, France

[73] Assignees: SMS Hasenclever GmbH, Dusseldorf, Germany; Hydro Aluminium a.s. Karmoy, Haavik, Norway

[21] Appl. No.: 525,541

[22] PCT Filed: Feb. 17, 1994

[86] PCT No.: PCT/DE94/00166

§ 371 Date: Feb. 12, 1996

§ 102(e) Date: Feb. 12, 1996

[87] PCT Pub. No.: WO94/19124

PCT Pub. Date: Sep. 1, 1994

[30] Foreign Application Priority Data

Feb. 18, 1993 [DE] Germany ..... 43 05 012.3

[51] Int. Cl.[6] ..... B21C 33/00

[52] U.S. Cl. ..... 72/270; 72/257; 72/342.2; 72/342.6

[58] Field of Search ..... 72/257, 270, 253.1, 72/268, 271, 201, 342.2, 342.3, 342.5, 342.6, 342.94, 364

[56] References Cited

U.S. PATENT DOCUMENTS

| | | | |
|---|---|---|---|
| 3,173,283 | 3/1965 | Vogtmann | 72/270 |
| 4,245,818 | 1/1981 | Elhaus et al. | 266/87 |
| 4,393,917 | 7/1983 | Fuchs, Jr. | 72/270 |
| 4,444,556 | 4/1984 | Andersson | 432/85 |
| 4,448,614 | 5/1984 | Morimoto et al. | 148/12.1 |
| 4,666,665 | 5/1987 | Hornsby et al. | 72/342.3 |
| 4,758,398 | 7/1988 | Sparapany et al. | 72/271 |
| 5,027,634 | 7/1991 | Visser et al. | 72/270 |
| 5,197,319 | 3/1993 | Beekel et al. | 72/268 |
| 5,306,365 | 4/1994 | Reighard | 72/342.6 |
| 5,325,694 | 7/1994 | Jenista | 72/270 |
| 5,327,763 | 7/1994 | Kramer et al. | 72/257 |
| 5,345,799 | 9/1994 | Miodushevski et al. | 72/342.6 |
| 5,359,874 | 11/1994 | Buckley et al. | 72/256 |
| 5,560,240 | 10/1996 | Forster et al. | 72/257 |

FOREIGN PATENT DOCUMENTS

| | | | |
|---|---|---|---|
| 1049675 | 12/1953 | France . | |
| 1 014 678 | 8/1957 | Germany . | |
| 57-159214 | 10/1982 | Japan . | |
| 62-77749 | 10/1994 | Japan | 72/270 |

OTHER PUBLICATIONS

Patent Abstracts of Japan, vol. 6, No. 267 (M–182) (1145), Dec. 25, 1982.

SMS Schloemann–Siegmag AG, advertisement p. W6/1165 of Jun. 1979.

SMS Schloemann–Siemag AG, brochure W6/3033 of Jun. 1982.

*Primary Examiner*—Lowell A. Larson
*Assistant Examiner*—Ed Tolan
*Attorney, Agent, or Firm*—Jacobson, Price, Holman & Stern, PLLC

[57] ABSTRACT

The object of the invention is to apply an appropriate temperature profile to a bloc to be extruded, at which the extrusion process may be optimized For that purpose, the metal blocks (10a) to be extruded are heated (furnace 2) up to an appropriate extrusion temperature for that metal, are stored at that temperature (holding chamber 3) and are chilled (chamber 5) according to regulation areas (18) in synchronism with the extrusion cycle. Regulation in the areas (18) is carried out by influencing the amount and/or temperature of the coolant, and/or cooling duration, so that an axial and radial temperature distribution is obtained at the block. This temperature distribution allows isothermic extrusion at an optimum extrusion speed, taking into account the heat conductivity of the metal, the heat flow to the remaining block, to the block support and to the extrusion tools (die, matrix), as well as the increase in temperature of the block due to the heat produced forming and by friction of the block against its support, when such friction is present, i.e., in the case of direct extrusion.

4 Claims, 3 Drawing Sheets

PROCESS AND DEVICE FOR APPLYING A TEMPERATURE PROFILE TO METAL BLOCKS FOR EXTRUSION

During metal extrusion processes, the blocks heated to extrusion temperature are taken from a container and extruded through a die; for insertion to take place the outer diameter of the blocks must be slightly smaller than the inner diameter of the container. After the block has initially been upset so that it fills the inner diameter of the container, it is extruded through the die to produce an extruded product. The heat released by the forming work flows away into the remainder of the block, the die and its holder, and the container. Additionally, during direct extrusion the block slides or shears along the wall of the container in a manner dependent on the prevailing tribological conditions, heat thereby being produced in the region near the surface of the block. A proportion of this heat also remains in the block for extrusion. Hence during the course of extrusion the block and the forming region become increasingly hotter and consequently the structure of the extruded product has different mechanical properties both radially and over the extruded length. In order to eliminate this phenomenon, an isothermal extrusion process is sought by varying the extrusion speed over the length of the block, or by applying an axial temperature gradient to the block before the beginning of the extrusion process, the end of the block near the die being hotter than the end near the ram.

Pusher-type induction heating means are used to produce a temperature gradient which can be reproduced during the extrusion cycle, the means being known from DE-B 1 014 678, the block firstly being heated therein to a uniform lower temperature in a first furnace or part of a furnace, and then being further heated in a second furnace or part of a furnace by induction in a regionally differing manner so that the block has a higher temperature at one end. Use of an induction-heating installation allows production of a temperature gradient which can be better reproduced, the installation being provided with a plurality of—generally four or more—induction coils which can be adjusted and controlled separately. Because of its complicated structure the installation is costly and entails considerable additional investment on the part of the authority operating the extrusion installation.

However, application of an axial temperature gradient by regionally differing induction heating is not sufficient for optimising the extrusion speed under isothermal extrusion conditions. In addition to application of an axial temperature gradient, this requires application of a reproducible radial temperature gradient, more particularly one having a temperature which decreases from the inside outwards, when using direct extrusion. This cannot be achieved by induction heating.

The object of the invention is to use a suitable temperature influence on the block for extrusion in order to apply a temperature profile thereto, with which profile the extrusion process, i.e. isothermal extrusion at maximum extrusion speed, can be optimised whilst taking into account all influencing quantities.

In accordance with the invention, the temperature influencing takes place in that the metal blocks for extrusion are heated to an extrusion temperature suitable for the metal, the blocks are stored at this temperature and undergo chilling in a manner synchronised with the extrusion cycle, the chilling being divided into control zones, control in the zones taking place by influence on the amount and/or temperature of coolant and/or the duration of cooling in such a way as to provide the block both axially and radially with a temperature distribution ensuring isothermal extrusion at optimal extrusion speed whilst taking into account the heat conductivity of the metal, the heat flow to the remainder of the block, the block container and the extrusion tools (ram and die) and heating of the block brought about by forming heat and (if present, i.e. during direct extrusion) friction of the block inside the container.

Application of the temperature gradient in the axial direction from the end of the block near the die towards the end remote from the die—which takes place in the simplest manner according to a further feature of the invention, namely in that the duration of cooling is regionally determined by relative movement of the metal block towards the controlled-cooling zones—simultaneously allows application of the required temperature gradient in the radial direction. According to a further feature of the invention, relative movement of the metal block towards the cooling zones takes place at a controllable speed, and the intensity of cooling can be adjusted for each zone by adjusting the amount and/or pressure and/or temperature of the coolant.

In relation to the prior art it should be pointed out that in order to avoid inclusion of air in the blocks for extrusion a temperature gradient is applied in such a way that at the initial extrusion force the hotter end of the block near the die is upset first, and from there onwards the block is then progressively upset and the air is forced out of the container. Application of the temperature gradient takes place according to FR-PS 1 049 675, in that the evenly pre-heated blocks for extrusion undergo cooling prior to upsetting in the container, at the end of the block remote from the die and beginning from the end surface thereof.

An installation for carrying out the process of the invention comprises a furnace heated by gas or electricity for uniform heating of the blocks for extrusion and storage thereof at a temperature which is equal to or slightly higher than the extrusion temperature suitable for extruding the blocks, a chamber divided into a plurality of zones of separately controllable cooling intensity for regionally controlled chilling of the preheated blocks, and means for transporting the blocks from the furnace to the chilling chamber and onwards to the block-loading means. It is advantageous to provide means for relative axial displacement of the chilling chamber and the metal block during the chilling process, to allow simple regional control thereof.

A structurally advantageous embodiment of the installation is provided if the chilling chamber is arranged with a vertical axis above a transport means for the blocks, the transport means comprising two block-tilting means meeting in the vertical axis of the chilling chamber, and a push rod displacing the block relative to the chilling chamber is arranged coaxially therewith so as to be liftable and lowerable. It is advantageous for the drive means bringing about the lifting movement of the push rod—and hence the speed at which the push rod is lifted and lowered—to be adjustable.

It is advantageous in terms of storage of the heated blocks and recall thereof in a manner synchronised with the extrusion cycle if a temperature-compensating and heat-retaining chamber is provided at the output end of the furnace.

An embodiment of the invention is shown in the drawings.

Figure 1:
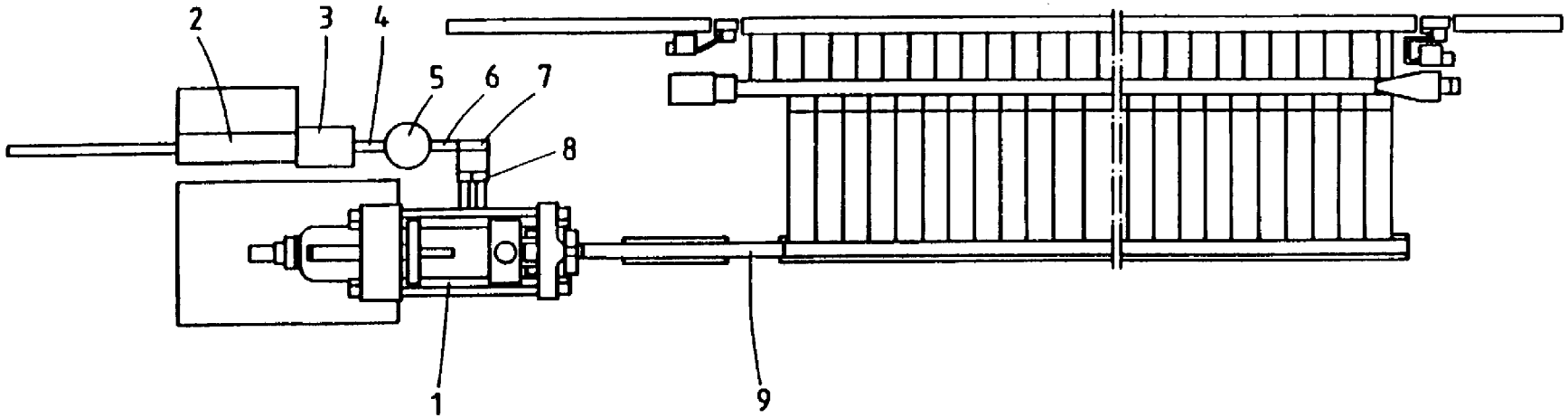
FIG. 1 is a plan view of an extrusion installation.

The extrusion installation shown in FIG. 1 comprises an extrusion press 1, a furnace 2, a heat-retaining chamber 3, a first block-tilting means 4, a chilling chamber 5, a second block-tilting means 6, a walking-beam conveyor 7, a block-loading means 8 and a delivery region 9 arranged after the extrusion press 1, with the conventional subsequent devices for further processing of the extruded product.

Figure 2:
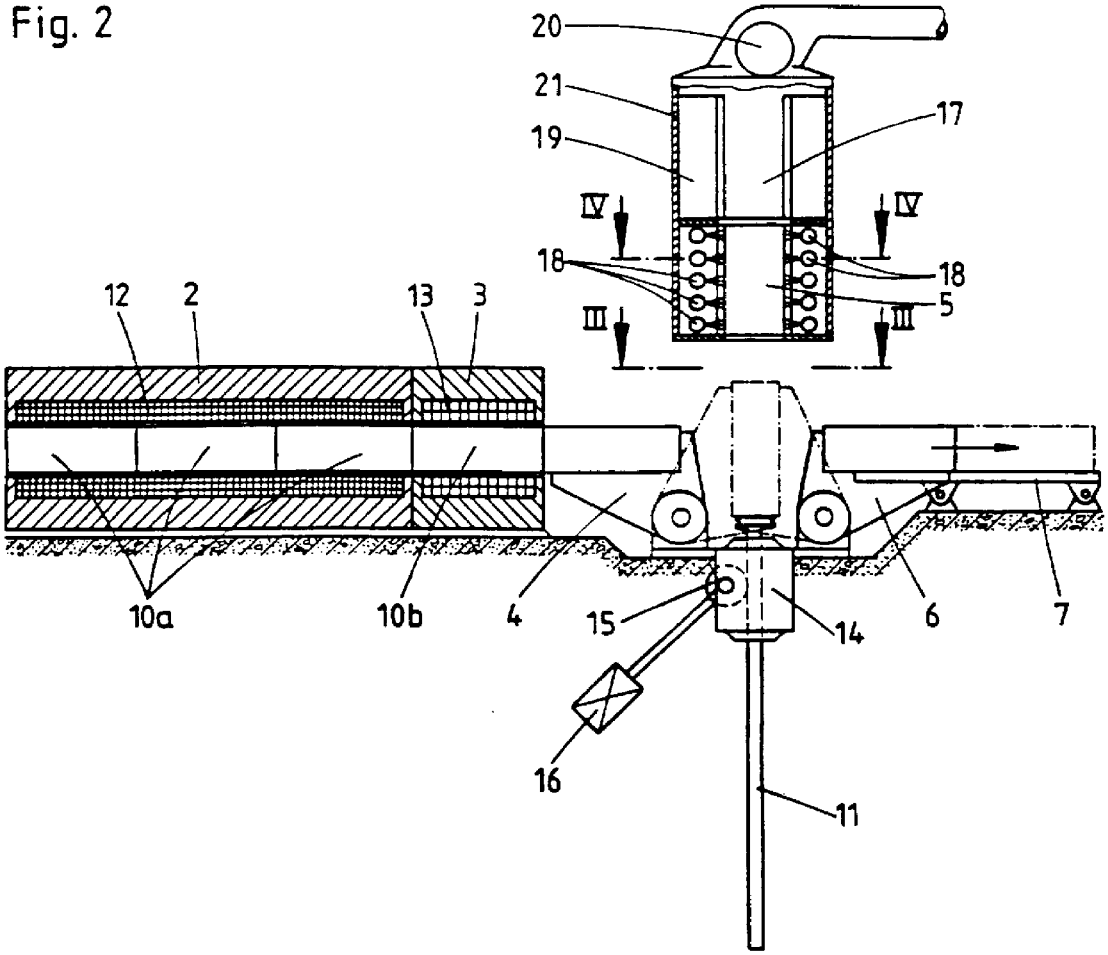
FIG. 2 shows a detail on a larger scale, in a partially sectional side view; and on a further enlarged scale in FIG. 3 there is shown a horizontal section along the sectional line III—III of FIG. 2; and in FIG. 4 there is shown a horizontal section along the sectional line IV—IV of FIG. 2.
Figure 3:
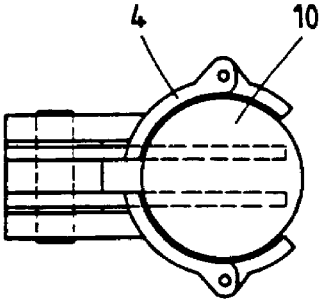
Figure 4:
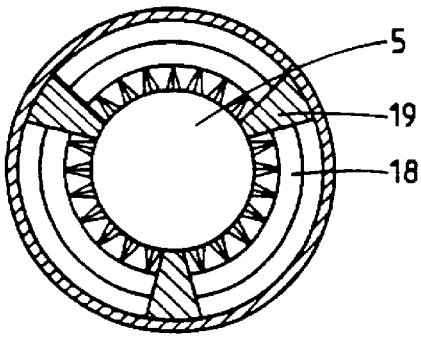

As shown in detail in FIG. 2, the induction furnace 2 provided with a horizontally arranged coil 12 is provided to receive a plurality of blocks 10*a*. The blocks 10 are pushed into the furnace 2 by a push rod (not shown). A heat-retaining chamber 3 is arranged after the furnace 2, and each block 10*b* which is next in line for extrusion, and has been heated in the furnace 2 to a temperature suitable for its extrusion, is stored in the said chamber 3. The heat-retaining chamber 3 is provided with a coil 13 in order to maintain the temperature of the block 10*b* during its dwell time in the heat-retaining chamber 3, the dwell time also being used to bring about uniformity of the temperature of the block 10*b*.

In a manner synchronised with the next extrusion cycle, the block 10*b* is pushed out of the heat-retaining chamber and passes on to the block-tilting means 4, by means of which the block is tilted into a vertical position which is below the chilling chamber 5 and coaxial therewith. A push rod 11 is arranged beneath the block in this position, and is coaxial with the block and the chilling chamber 5.

The push rod 11 formed as a toothed rack is guided inside a casing 14. The push rod 11 is vertically displaceable via a pinion 15 driven by a motor 16 of adjustable speed, into an upper position in which the block is raised by the tilting means 4 and is lifted as far as a position above the chilling chamber 5, where it is held by a cage 17.

Figure 5:
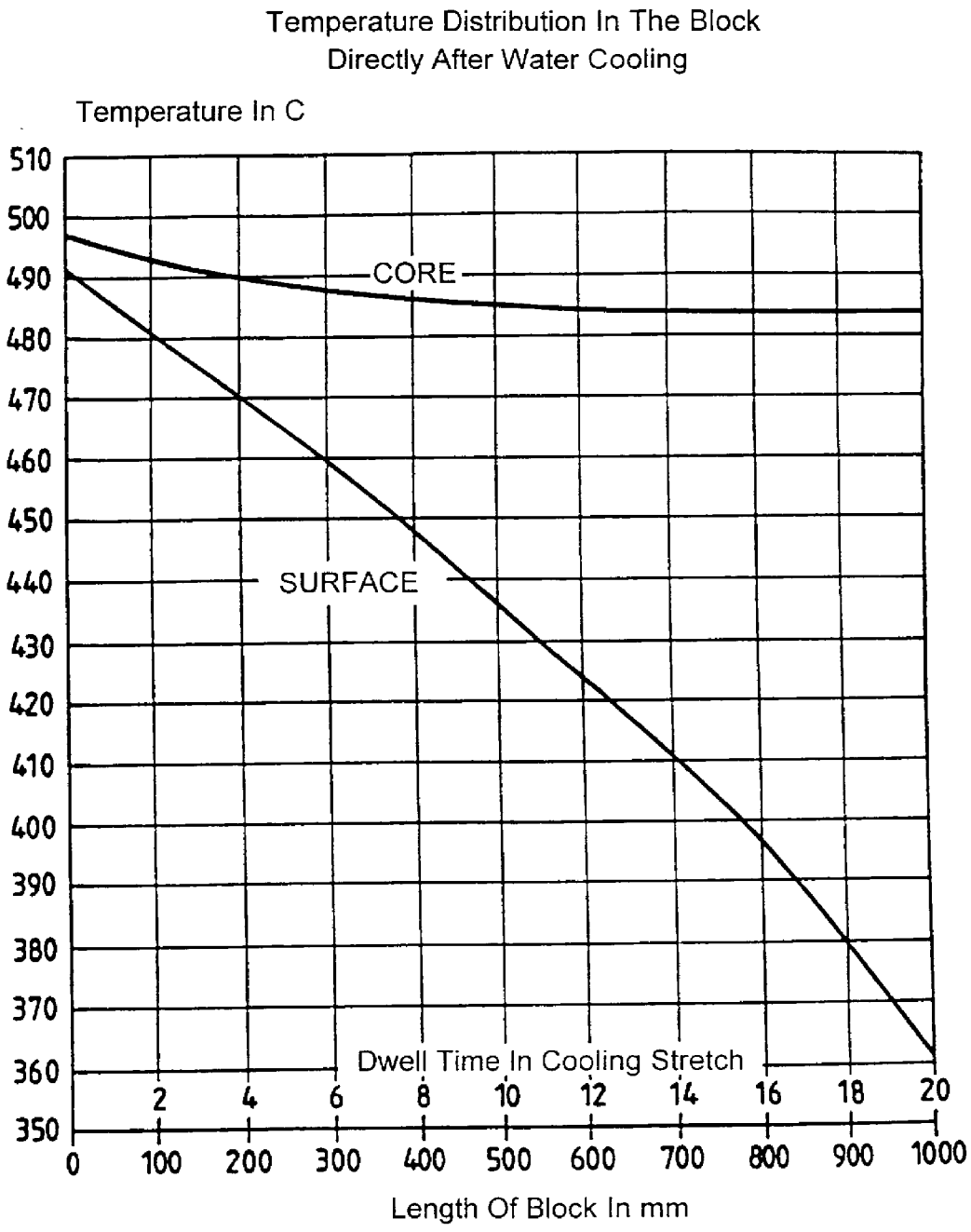
FIG. 5 shows a graph of the temperature distribution in the block at the moment when cooling ends.

Rings 18 of nozzles—five rings in the embodiment shown—are provided one above another in the chilling chamber 5 and form cooling zones, the rings 18 of nozzles being supplied separately with coolant so that the amount, pressure and temperature of coolant and the duration of cooling can be controlled separately in each ring 18 of nozzles, i.e. in each cooling zone. Strips 19 which extend through the cooling chamber 5 and the cage 17 guide a block whilst it is moving inside the cooling chamber 5 or the cage 17. By means of a fan 20 evaporating coolant is sucked out of a casing 21 surrounding the cooling chamber 5 and the cage 17. As soon as a block has reached its upper position in the cage 17 it is acted upon by the coolant via the rings 18 of nozzles, and the block is lowered at a controlled speed by means of the push rod 11 until it is located entirely in the cooling chamber 5 and the coolant supply is discontinued. If, for example, the block is to be extruded using a direct extrusion process, the cooling is adjusted in such a way that when the block leaves the cooling chamber 5 it has a temperature distribution which can be seen from the graph in FIG. 5. The uppermost end of the block has not been acted upon by the coolant, whilst the lower end has been acted upon during the entire lowering time of 20 seconds by coolant of a controlled amount, pressure and temperature. The temperature distribution is set in such a way that the block can be isothermally extruded at optimal extrusion speed.

As soon as a block 10*b* positioned below the cooling chamber 5 by the block-tilting means 4 has been lifted by the push rod 11 into the region of the cooling chamber 5 and the cage 17, the block-tilting means 4 is pivoted back into its starting position where it is ready to receive a further block 10*b*. Directly thereafter the block-tilting means 6 is pivoted into a position below the cooling chamber 5, before the block in the cooling chamber 5 has been lowered by the push rod 11, so that the block-tilting means 6 can take over the block emerging from the cooling chamber 5. The block-tilting means 6 then deposits the block on a walking-beam conveyor 7 which delivers the block to the block-loading means 7 [sic - 8] which then loads the block into the extrusion press 1.

We claim:

1. An installation for applying a temperature profile to metal blocks for extrusion in metal-extrusion presses, the installation comprising a furnace, a chamber divided into a plurality of zones of separately controllable cooling intensity for regionally controlled chilling of evenly pre-heated metal blocks with controlled movement of the metal block relative to the zones, and means for transporting the metal blocks from the furnace to the chilling chamber and on to a block-loading means of the metal-extrusion press, the chilling chamber having a vertical axis extending substantially parallel to a longitudinal axis of the metal block when the metal block is in the chilling chamber.

2. An installation for applying a temperature profile to metal blocks for extrusion in metal-extrusion presses, the installation comprising a furnace, a chamber divided into a plurality of zones of separately controllable cooling intensity for regionally controlled chilling of evenly pre-heated metal blocks with controlled movement of the metal block relative to the zones, and means for transporting the metal blocks from the furnace to the chilling chamber and on to a block-loading means of the metal-extrusion press, the chilling chamber having a vertical axis, the chilling chamber being arranged with said vertical axis above a transport means for the blocks, the transport means including two block-tilting means, and a push rod for displacing the block relative to the chilling chamber, said push rod being arranged below the chilling chamber coaxially therewith so as to be liftable and lowerable.

3. An installation according to claim 2, wherein a drive means for the lifting movement of the push rod and for controlling a speed at which the push rod is lifted and lowered is adjustable.

4. An installation according to claim 2, wherein a cage is arranged above the chilling chamber and the push rod is sized so that a block can be raised above the chilling chamber into the cage.

* * * * *